US009856708B2

(12) United States Patent
Pacey

(10) Patent No.: US 9,856,708 B2
(45) Date of Patent: Jan. 2, 2018

(54) ADJUSTABLE SEAT ASSEMBLY

(71) Applicant: HALLIBURTON ENERGY SERVICES, INC., Houston, TX (US)

(72) Inventor: Kendall Lee Pacey, Duncan, OK (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 223 days.

(21) Appl. No.: 14/784,880

(22) PCT Filed: Oct. 27, 2014

(86) PCT No.: PCT/US2014/062424

§ 371 (c)(1),
(2) Date: Oct. 15, 2015

(87) PCT Pub. No.: WO2016/068851

PCT Pub. Date: May 6, 2016

(65) Prior Publication Data

US 2016/0326820 A1 Nov. 10, 2016

(51) Int. Cl.
*E21B 23/04* (2006.01)
*E21B 34/14* (2006.01)
*E21B 43/12* (2006.01)

(52) U.S. Cl.
CPC ..... *E21B 23/04* (2013.01); *E21B 34/14* (2013.01); *E21B 43/12* (2013.01)

(58) Field of Classification Search
CPC ..... E21B 23/04; E21B 34/14; E21B 43/12
USPC ..... 166/386
See application file for complete search history.

(56) References Cited

U.S. PATENT DOCUMENTS

| | | | | |
|---|---|---|---|---|
| 8,668,016 | B2 | 3/2014 | Porter et al. | |
| 2011/0198100 | A1 | 8/2011 | Braekke et al. | |
| 2011/0315390 | A1* | 12/2011 | Guillory | E21B 21/103 166/329 |
| 2012/0012771 | A1* | 1/2012 | Korkmaz | E21B 23/04 251/315.07 |
| 2012/0227973 | A1 | 9/2012 | Hart et al. | |
| 2012/0261140 | A1* | 10/2012 | Xu | E21B 34/14 166/386 |
| 2012/0305236 | A1 | 12/2012 | Gouthaman | |
| 2013/0233564 | A1 | 9/2013 | Pacey | |
| 2014/0060813 | A1 | 3/2014 | Naedler et al. | |
| 2014/0352970 | A1* | 12/2014 | Kristoffer | E21B 43/12 166/318 |

OTHER PUBLICATIONS

International Search Report and Written Opinion dated Jul. 15, 2015 in International Application No. PCT/US2014/062424.

* cited by examiner

*Primary Examiner* — Taras P Bemko
(74) *Attorney, Agent, or Firm* — Polsinelli PC

(57) ABSTRACT

Disclosed herein is a seat assembly for a drill string, the seat assembly having an outer tubular member and a seat disposed therein. The seat has a bore having a central axis. A plurality of cuts extends radially from the bore to an outer perimeter of the seat, the plurality of cuts also extending a distance longitudinally along the length of the central axis. Each of the plurality of cuts is present at an angle oblique to the peripheral circumference of the bore.

25 Claims, 10 Drawing Sheets

ADJUSTABLE SEAT ASSEMBLY

CROSS-REFERENCE TO RELATED APPLICATIONS

This application is a national stage entry of PCT/US2014/062424 filed Oct. 27, 2014, said application is expressly incorporated herein in its entirety.

FIELD

The present disclosure relates generally to wellbore servicing systems, and particularly to an adjustable seat assembly that can operate with different sized obturators.

BACKGROUND

Subterranean formations that contain hydrocarbons are sometimes non-homogeneous in their composition along the lengths of wellbores that extend into such formations. It is sometimes desirable to treat and/or otherwise manage the formation and/or the wellbore differently in response to the differing formation composition. Additionally, tools can be provided along the length of the wellbore which may need activation. One way to isolate zones or to activate tools is by use of an obturator. An obturator may be a ball, for example. The obturator can be dropped from the surface and/or pumped through a tubular work string. During passage through the work string, the obturator may strike a tool for activation. Alternatively, the obturator may land on a seat provided in the work string, or alternatively pass through one or more seats. The seats are provided with a bore having a particular diameter which permits or prevents passage of the obturator, depending on the corresponding size of the obturator. When landing on a seat, an obturator may block the bore in the seat and thus seal off the lower portion of the tubular work string.

BRIEF DESCRIPTION OF THE DRAWINGS

Implementations of the present technology will now be described, by way of example only, with reference to the attached figures, wherein.

DETAILED DESCRIPTION

Figure 1A:
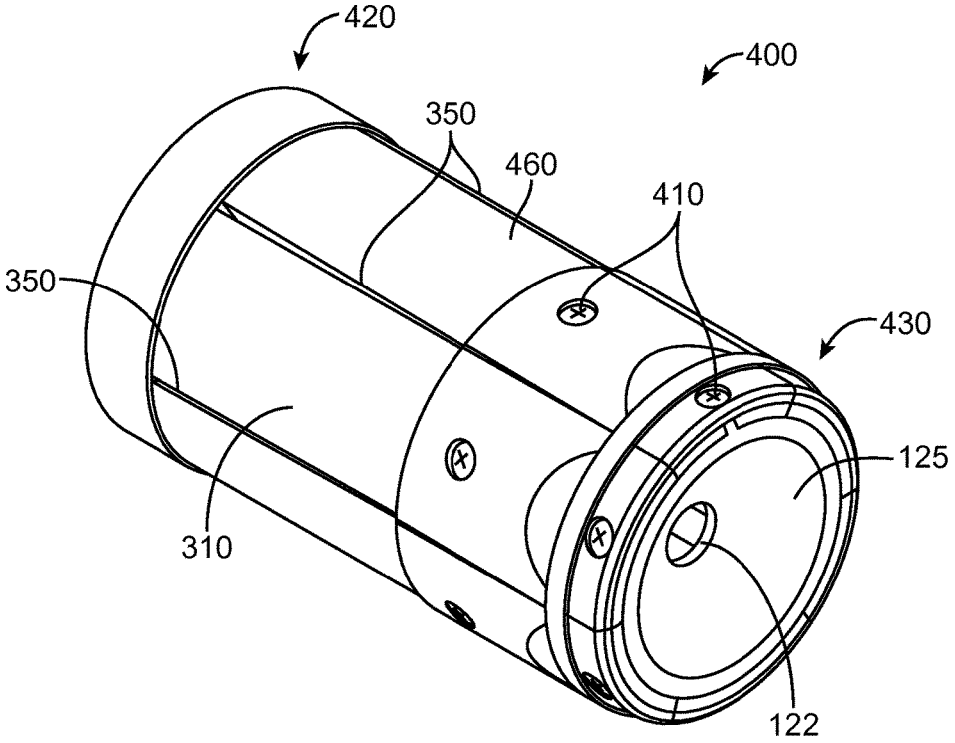
FIG. 1A is a diagram of one exemplary seat assembly according to the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the following description, terms such as "upper," "upward," "lower," "downward," "above," "below," "downhole," "uphole," "longitudinal," "lateral," and the like, as used herein, shall mean in relation to the bottom or furthest extent of, the surrounding wellbore even though the wellbore or portions of it may be deviated or horizontal. Correspondingly, the transverse, axial, lateral, longitudinal, radial, and the like orientations shall mean positions relative to the orientation of the wellbore or tool. Additionally, the illustrated embodiments are depicted so that the orientation is such that the right-hand side is downhole compared to the left-hand side.

Several definitions that apply throughout this disclosure will now be presented. The term "coupled" is defined as connected, whether directly or indirectly through intervening components, and is not necessarily limited to physical connections. The connection can be such that the objects are permanently connected or releasably connected. The term "communicatively coupled" is defined as connected, either directly or indirectly through intervening components, and the connections are not necessarily limited to physical connections, but are connections that accommodate the transfer of data between the so-described components. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other thing that "substantially" modifies, such that the component need not be exact. For example, substantially cylindrical means that the object resembles a cylinder, but can have one or more deviations from a true cylinder. The terms "comprising," "including" and "having" are used interchangeably in this disclosure. The terms "comprising," "including" and "having" mean to include, but not necessarily be limited to the things so described.

The term "radial" and/or "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Illustrated in FIG. 1A is a seat assembly 400 having an outer tubular member 310 containing a seat 300 (described in FIGS. 1B and 1C below) for receiving an obturator. The outer tubular member 310 is substantially circular in shape to correspond to tubing or other tubular conveyance in a borehole. Other shapes can be employed, but can correspond to the shape and size of the tubular conveyance. The outer tubular member 310 has a plurality of cuts 350. The cuts 350 can originate at or near the second end 430 and extend longitudinally toward the first end 420. The cuts can extend along the entire length or just a portion. An elastomeric cover 125 with an aperture 122 can be provided for protection of the seat contained therein. Fasteners 410, such as screws, can be provided to couple the seat 300 to the outer tubular member 310.

Figure 1B:
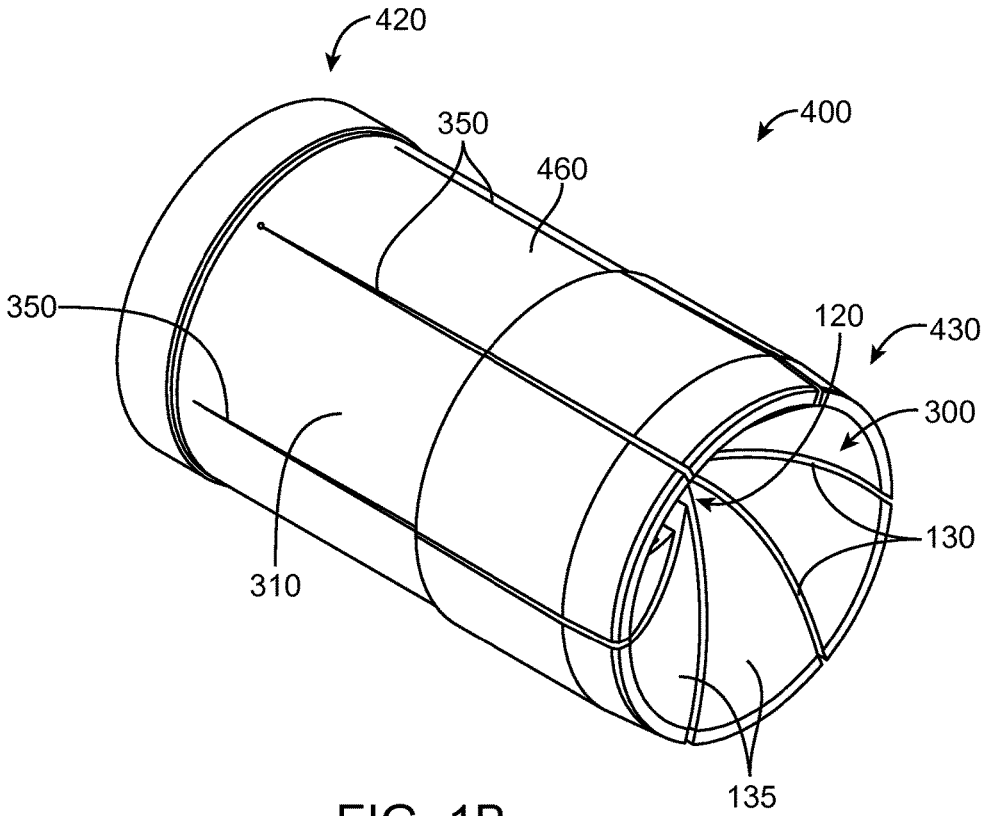
FIG. 1B is a diagram of one exemplary seat assembly according to the present disclosure.

FIG. 1B illustrates seat assembly 400 without an elastomeric cover 125. As shown, a seat 300 is contained within the outer tubular member 310. Further the seat 300 can be conical shaped on one or both sides (or faces), for example facing the first end 420 or second end 430, the conical shape being shown on the second end 430 in FIG. 1B. In the embodiment featured in FIG. 1B, rather than using fasteners, the seat 300 can be coupled to the outer tubular member 310 via threaded engagement, thus rotating the seat 300 into the outer tubular member 310. The seat 300 can have a plurality of cuts 130 extending radially from the central bore 120 to the outer perimeter of the seat (or from the outer perimeter of the seat to the central bore 120). The plurality of cuts, which can also be referred to as slices, boundaries or divisions which extend to the bore 120, can be provided through the outer tubular member 310 and the seat 300, such that cuts 350 in the outer tubular member 310 align with the cuts 130 provided in the seat 300. The plurality of cuts 130 in the seat form a plurality of segments 135. The particular shape and position of the plurality of cuts 130 permit adjustment of the diameter of the bore 120, and also, as a consequence, permit adjustment of the diameters of the outer tubular member 310 and adjustment of the seat 300. The "cuts" can be formed in any manner, for example, via a saw or other cutting tool. Additionally, the plurality of cuts can also be pre-formed in the structure without a cutting action, for example casting or combining a plurality of segments 135 together.

Figure 1C:
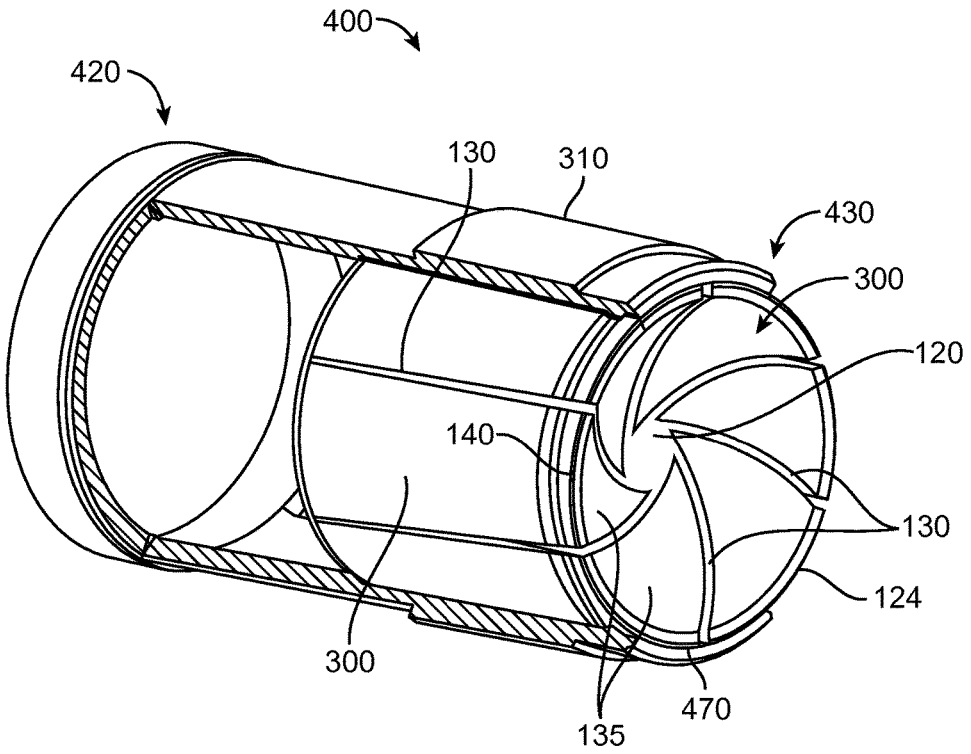
FIG. 1C is a diagram of one exemplary seat assembly according to the present disclosure.

FIG. 1C illustrates the same seat assembly 400 as that of FIG. 1B, but with a section of the outer tubular member 310 removed. As shown the plurality of cuts 130 form a plurality of segments 135 in the seat 300. Segments 135 are shaped with a broader outer periphery narrowing or tapering toward a tip or end terminating at the bore 120.

Figure 2:
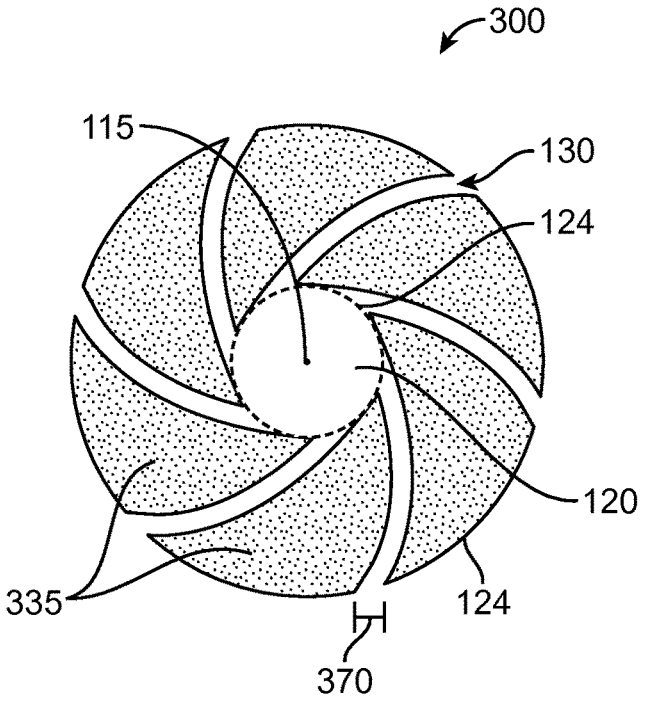
FIG. 2 is a diagram of one exemplary seat according to the present disclosure.

The seat 300 has a longitudinal central axis and a bore 120. As noted, seat 300 has a plurality of cuts 130 radially extending from the outer perimeter 140 of the seat to the bore 120. As shown in FIG. 2, each of the plurality of cuts 130 are present at an angle oblique to the peripheral circumference 124 (i.e., tangent of the circumference) of the bore 120. In other words, the cuts 130 extend in a direction which is not aligned with, or would not pass through, the central axis 115 of the bore 120. The bore 120 is substantially circular, and has a central axis which is approximately equidistant from all points of the circumference of the bore 120. In some instances, the bore 120 can be oval shaped. If other shapes are employed other than a circle, such as square, rectangular or other polygon, the cuts 130 would extend in a direction which is not aligned with the central axis.

Figure 2A:
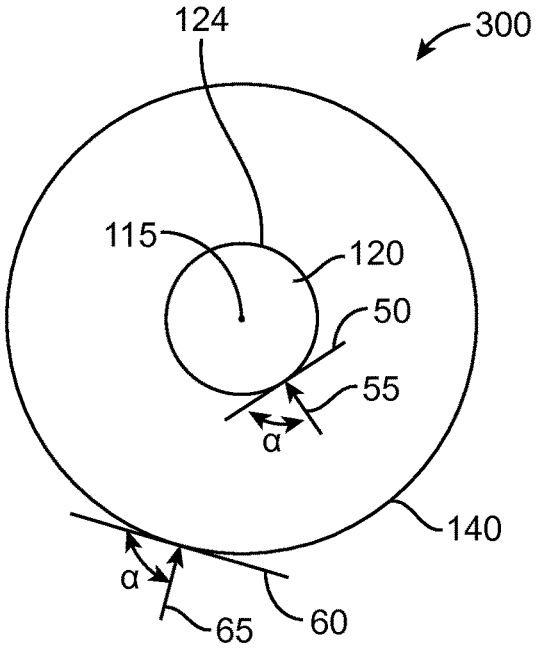
FIG. 2A is a simplified diagram of one exemplary seat according to the present disclosure.

Accordingly, because each of the plurality of cuts 130 is oblique they extend from about 1° to about 89° relative to the tangent of the peripheral circumference 124 of the bore 120. For illustrative purposes, a simplified illustration of seat 300 is shown in FIG. 2A. Therein, the bore 120 has a peripheral circumference 124, with a tangent line 50. The normal 55 is perpendicular to the tangent line 50, and by definition, if extended would pass through the central axis 115. Accordingly, each of the plurality of cuts 130 extends toward the bore 120 at an angle $\alpha$ oblique to the tangent line 50, as well as at an angle to the normal 55. The angel $\alpha$ is from about 1° to about 89° relative the tangent line 50. As a result, each one of the plurality of cuts 130 is oblique to the peripheral circumference of bore 120 and are not aligned with the central axis 115. This configuration permits the size, that is, the diameter, of bore 120 to be adjusted. For example, in some instances by applying pressure, such as by squeezing the seat 300, the cuts permit the segments 135 to move relative to one another, and in some cases, if abutting one another, to slide relative to one another, causing the size of the bore 120 to change. In some instances, the movement of the segments 135 acting to change the size of the borehole is comparative to a camera shutter.

Correspondingly, the plurality of cuts 130 are made at an angle oblique to the outer perimeter 140 of the seat 300. For example, a tangent line 60 is shown, along with normal 65 which is perpendicular to the tangent line 60. By definition, the normal, if extended, passes through the central axis 115 of the bore 120 (which is also the central axis of the seat 300 and tubular member 310). Accordingly, the plurality of cuts 130 are made at the angle $\alpha$ oblique to the tangent 60, and are not aligned with the central axis 115. Further, the plurality of cuts 350 in the outer tubular member 310 are made oblique to the tangent of the outer surface of outer tubular member 310. The plurality of cuts 130 in the seat 300 may align with the plurality of cuts 350 in the outer tubular member 310.

Referring again to FIG. 2, each of the plurality of cuts 130, 350 is present at an angle from about 1° to about 89° relative to the peripheral circumference 124 of the bore 120. The angle of each of the plurality of cuts can act to reduce erosion of the seat 300 due to expulsion of a propellant as the propellant will flow with the cut instead of across the cut, as in segmented seats. In an aspect, the angle of each of the plurality of the cuts 130, 350 ranges from about 1° to about 89°, and for example from about 10° to 80°, for example from about 20° to about 70°, and as a further example is 45°. The cuts 130, 350 themselves can be curved as shown in FIG. 2, or straight, as they radially extend from the outer surface 460 of the outer tubular member 310 and/or outer perimeter 140 of the seat 300 to the bore of the outer tubular member. The plurality of cuts 130, 350 cause the seat 300 and outer tubular member 310 to be flexible and able to contract and expand due to internal or external pressures.

With respect to the seat 300 shown in FIG. 2, it will be understood that the peripheral circumference 124 of the bore 120 may not necessarily be continuous due to gaps caused by the cuts 130. However, the peripheral circumference can be formed by the inner surface of the segments despite any gaps formed by the plurality of cuts 130. Similarly the outer perimeter 140 and outer surface 460 may be discontinuous due to gaps formed by plurality of cuts 130.

For example, each of the plurality of cuts 130 and 350 present in the seat 300 and the outer tubular member 310 may be separated by a gap 370. The gap 370 can be from 0.001 mm to 2 mm. In some cases, the cuts 130 may not have any width, and serve rather as divisors between segments 135. In such case, the segments 135 abut one another, and slide relative to one another when being adjusted (further described below). Further, the width of the gaps 370 can change as the seat 300 is adjusted.

In another aspect, the seat 300 and/or the outer tubular member 310, each independently, can include from about 2 to about 100 cuts. As an example, the seat 300 and/or the outer tubular member 310, each independently, may include from about 6 to about 80 cuts, and as a further example is 10 cuts. In an aspect, there is no upper limit to the number of cuts in the seat 300 and/or the outer tubular member 310 of the seat assembly 400. The greater the number of cuts results in a fewer number of possible movements by any one of the segments 135 of the seat 300 and/or the outer tubular member 310.

Figure 3A:
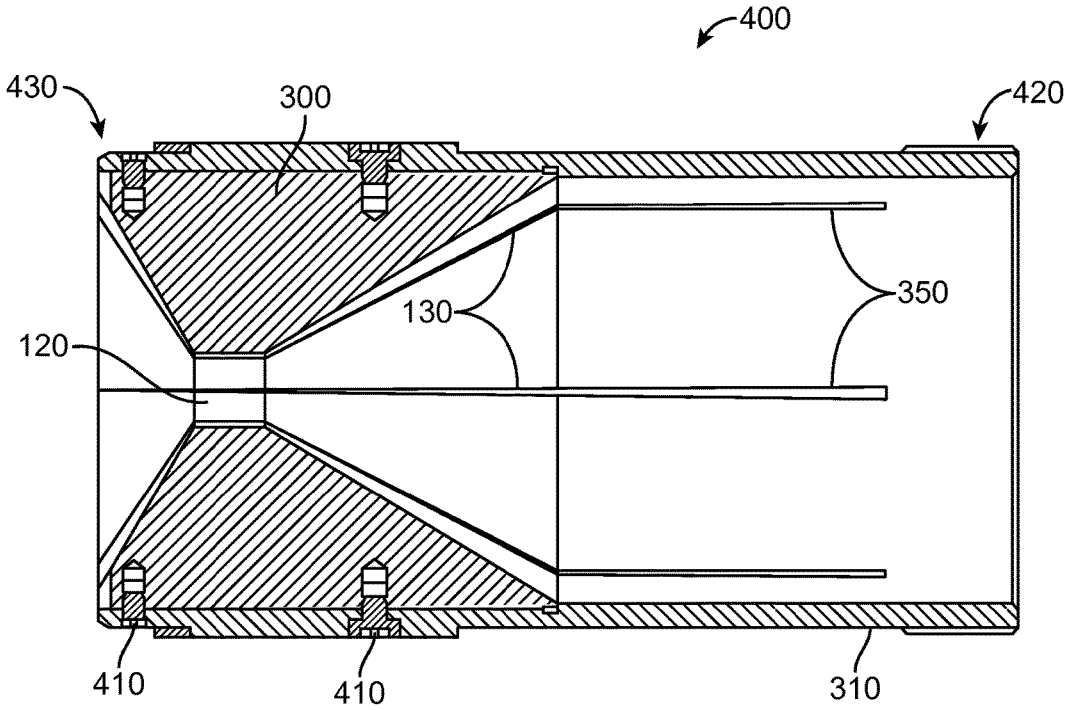
FIG. 3A is a sectional view of a seat assembly having a seat according to the present disclosure.
Figure 3B:
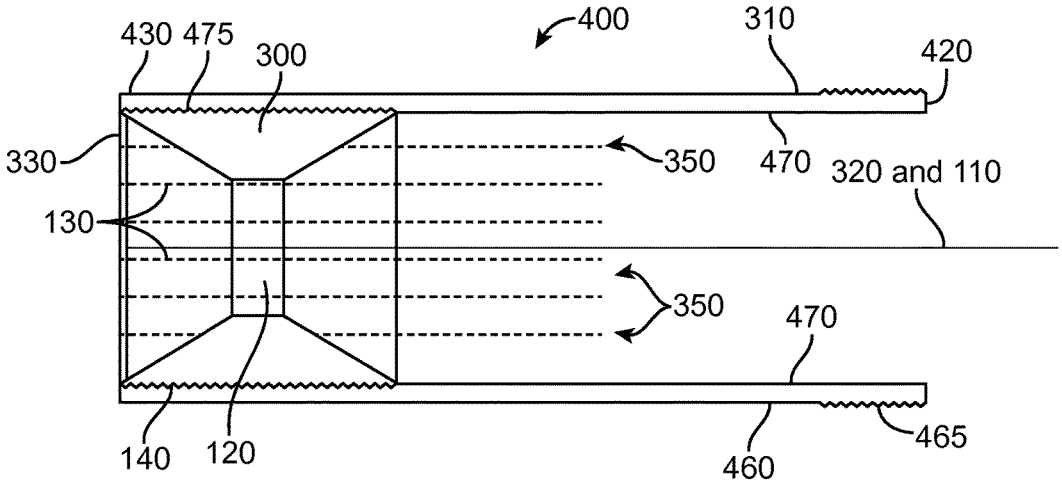
FIG. 3B is a sectional view of a seat assembly having a seat according to the present disclosure.
Figure 3C:
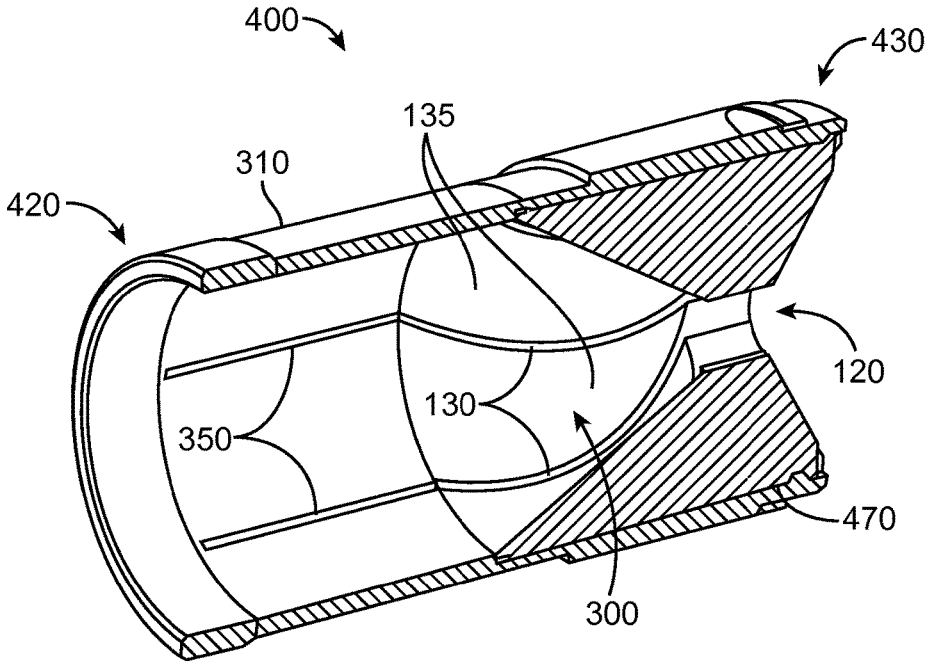
FIG. 3C is a half-section view of a seat assembly having a seat according to the present disclosure.

Referring now to FIGS. 3A-3B, a sectional view of a seat assembly 400 having a seat 300 and an outer tubular member 310 is disclosed. The seat 300 can be disposed adjacent to or inside the outer tubular member 310. As shown, the seat 300 can be conical shaped on both sides (or faces). The plurality of cuts 130 of the seat 300 and the plurality of cuts 350 of the outer tubular member 310 can be aligned with each other, although this is not necessary. FIG. 3C illustrates a half section of the seat assembly 400 in a perspective view with the plurality of cuts 130 and 350.

The outer tubular member 310 and the seat 300 of the seat assembly 400 can be made from the same or different materials. The material may be characterized as drillable, that is, they may be fully or partially degraded or removed by drilling. In an aspect, the drillable material may be selected from the group consisting of composites, phenolics, cast iron, aluminum, brass, various metal alloys, rubbers, ceramics, or combinations thereof. In an aspect, the outer tubular member 310 is integral with the seat 300 because they are made from the same material, as shown, for example, in FIGS. 1B, 1C, and 3C.

In another aspect, as shown in FIGS. 1A and 3A, the outer tubular member 310 is not integral with the seat 300. For example, the outer tubular member 310 can be made from a stronger material as compared to the seat 300, which can be made from a weaker material. In this instance, it may be necessary to couple the outer tubular member 310 with the seat 300. Multiple mechanical and chemical means exist for coupling, joining or attaching these two components of the seat assembly 400. Non-limiting mechanical and chemical means for coupling include nails, screws, epoxies, adhesives, groove designs, bonding agents, and combinations thereof. As an example, FIGS. 1A and 3A depict screws 410 that couple the outer tubular member 310 to the seat 300 to form a seat assembly 400.

In another example, as shown in FIG. 3B, the outer tubular member 310 can have a first end 420 having an externally threaded portion 465 and a second end 430 having an internally threaded portion 475. The externally threaded portion 465 can be used to couple the seat assembly 400 to another tool. The second end 430 of the outer tubular member 310 can have an internally threaded portion 475 that couples with an externally threaded outer perimeter 140 of the seat 300.

In another aspect, a bonding agent can be applied to, for example, the inner surface 470 of the second end 430 of the outer tubular member 310, the outer perimeter 140 of the seat 300, and/or the outer surface 460 of the first end 420 of the outer tubular member 310. The bonding agent can couple the individual parts so that they will not move or come apart. For example, in operation a segmented seat can potentially come apart after an obturator passes through. The pieces of the seat could then spread throughout the seat assembly, which is undesirable. In the present disclosure, the ability of the inner diameters of the seat 300 and the outer tubular member 310 to expand and contract due to the plurality of cuts 130 and 350, respectively, and optionally in the presence of a bonding agent, aid in preventing the seat 300 from coming apart inside the seat assembly.

Figure 4A:
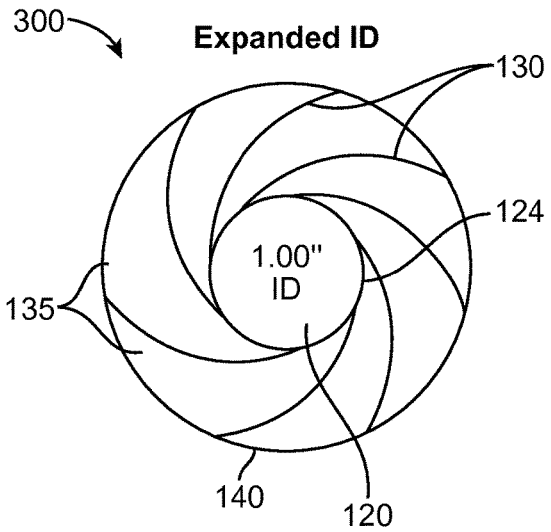
FIG. 4A is a diagram of one example of a seat assembly having a bore with an expanded diameter.
Figure 4B:
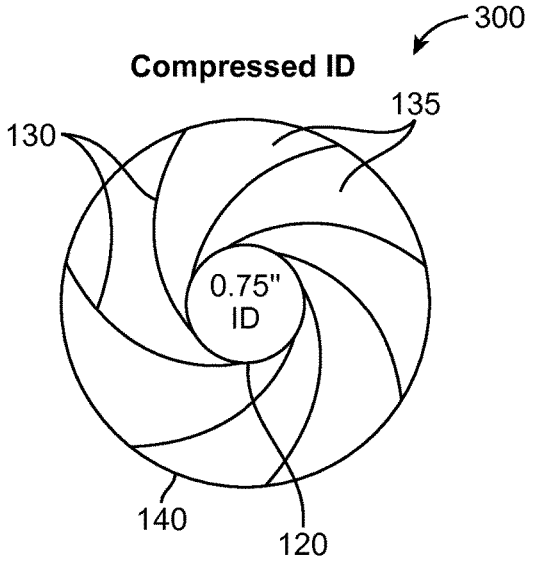
FIG. 4B is a diagram of one example of a seat assembly having a bore with an contracted diameter.

As shown in FIGS. 4A and 4B, the diameter of bore 120 can be expanded or contracted. At the same time the bore 120 expands or contracts the outer perimeter of the seat 300 and outer tubular member 310, are correspondingly expanded or contracted. The range the diameter bore 120 can expand or contract is dependent upon the gaps 370 between each cut and the number of cuts 130 and 350. In an aspect, the bore 120 can be expanded due to an internal pressure, such as an obturator 500. In an aspect, the bore 120 can expand to a size equal to or greater than the diameter of the obturator. In another aspect, the inner diameter of bore 120 can contract/compress to a size equal to or smaller than the diameter of the obturator.

Figure 5:
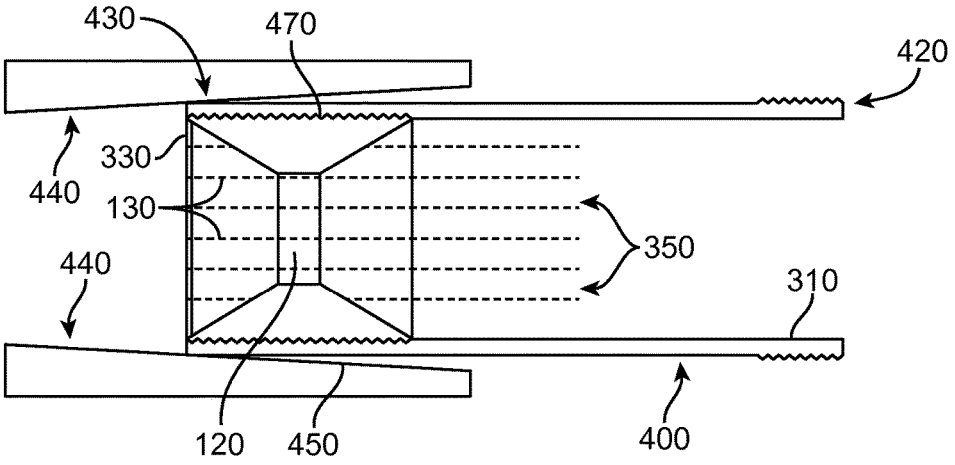
FIG. 5 is a sectional view of a seat assembly in accordance with the present disclosure.

As shown in FIG. 4B, the inner diameter 120 can be compressed due to an external pressure, such as a chamfer. For example, the inner diameter of the bore 120 can be adjusted from 1.00 inch as shown in FIG. 4A to 0.75 inches as shown in FIG. 4B (where ID stands for inner diameter of the seat assembly 400, which is the diameter of the bore 120). At the same time the bore 120 contracts, the outer tubular member 310 would correspondingly contract. In particular, as shown in FIG. 5, a seat assembly 400 can also include an adaptor 440 having a chamfer 450 to engage at least one of the front face 330 of the outer tubular member 310.

As the front face 330 engages with a chamfer 450 of an adaptor 440, the seat 300 and the outer tubular member 310 will compress from a first inner diameter to a narrower third inner diameter. The angle of the chamfer 450 on the adaptor 440 can determine the narrowness of the third inner diameter. In an aspect, the inner diameter of bore 120 can compress to a size equal to or smaller than the diameter of the obturator 500. In an aspect, the inner diameter of bore 120 can be compressed because the front face 330 of the outer tubular member 310 engages with the chamfer 450 of the adapter 440. Because the diameter of the bore 120 and the diameter of outer tubular member 310, respectively, are able to expand or contract, it can be practical to use one seat assembly 400 for many different sized obturators 500.

Figure 6:
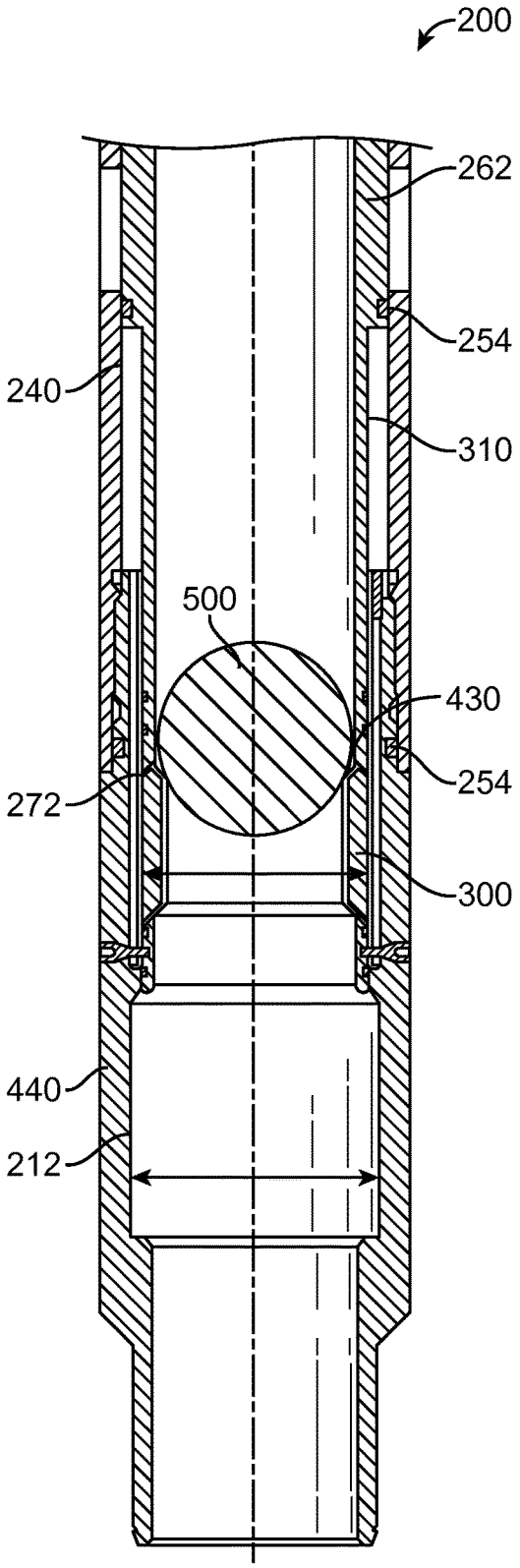
FIG. 6 is a diagram of a portion of a work string having a seat assembly in accordance with the present disclosure.

FIG. 6 illustrates a cross-sectional view of an embodiment of a stimulation and production sleeve system 200 (hereinafter referred to as "sleeve system" 200). Many of the components of sleeve system 200 lie substantially coaxial with a central axis of sleeve system 200.

Figure 7:
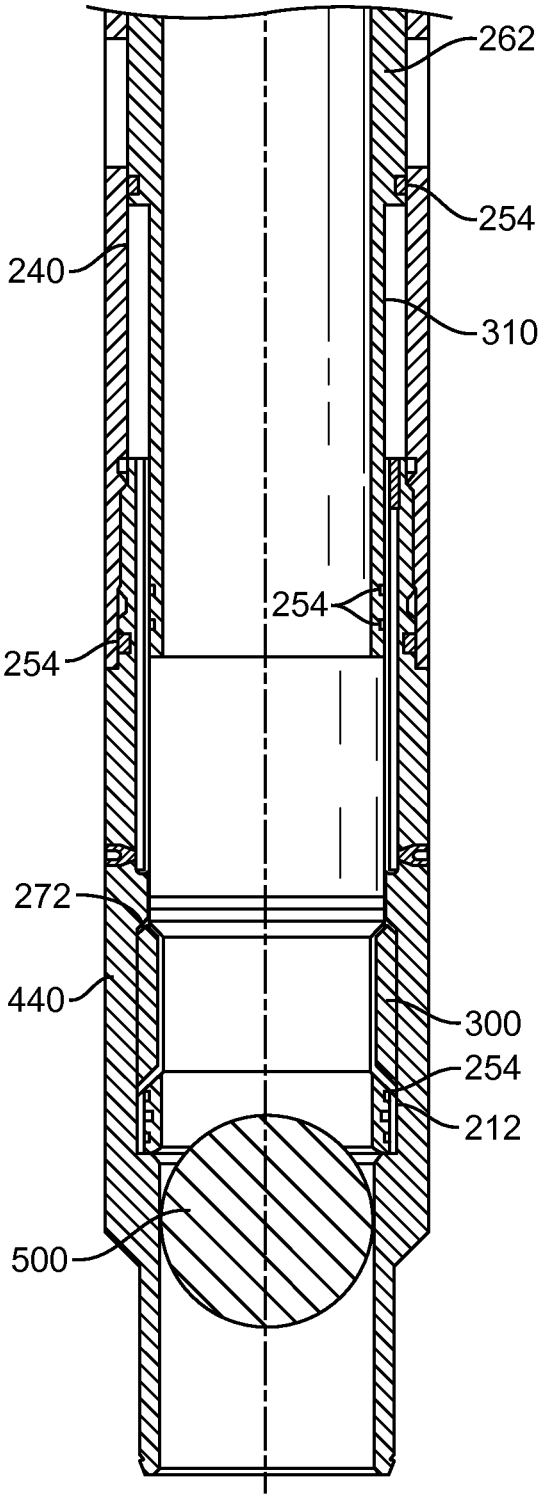
FIG. 7 is a diagram of a portion of a work string having a seat assembly in accordance with the present disclosure.

As shown in FIG. 6, the bore 120 may have a first diameter due to its location in the seat assembly 400 and/or the presence or absence of an obturator 500. As the obturator 500 is pushed via the internal pressure of propellant, the diameter of bore 120 can expand to a second diameter, as shown in FIG. 7 to accommodate the width of the obturator, thereby letting the obturator pass through. The diameter of bore 120 can be configured to expand to a size equal to or larger than the diameter of the obturator 500. The seat 300 disclosed herein does not erode or break apart due to the expansion of the diameters of bore 120 and inner surface 470.

The sleeve system 200 includes the disclosed seat assembly 400. In particular, the outer tubular member 310 is carried within a ported case below a piston. The outer tubular member 310 has an upper seal shoulder 262. With the exception of upper seal shoulder 262, the outer tubular member 310 has an outer diameter substantially smaller than the diameter of the lower inner surface 240. The upper seal shoulder 262 carries two circumferential seals 254, one seal 254 near each end (e.g., upper and lower ends) of the upper seal shoulder 262, that provide fluid tight seals between the upper seal shoulder 262 and the lower inner surface 240 of the ported case. Further, two seals 254 are carried by the outer tubular member 310 near a second end 430 of outer tubular member 310, and the two seals 254 form fluid tight seals between the outer tubular member 310 and the inner surface 212 of the adaptor 440.

Also disclosed herein is a method of servicing a wellbore 600 including positioning a work string 610 within the wellbore, the work string 610 having a seat assembly 400. At least one obturator 500 can be passed through at least a portion of the seat assembly 400, for example if the diameter of the bore 120 is larger than the obturator 500. Alternatively, the diameter bore 120 can be smaller than the diameter of the obturator 500, in which case it would block the bore 120. A plurality of different sized seat assemblies 400 can be used along with different sized obturators 500. Therefore, some obturators can pass through one or more seat assemblies 400 before coming to rest on a seat assembly 400 that has a smaller bore 120 diameter. Prior to installing the seat assembly 400 in the work string 610, the inner diameter of bore 120 can be adjusted by compressing the seat assembly as shown in FIG. 5. In some cases, the diameter of the bore 120 can be changed by forcing the obturator through with sufficient pressure.

It will be appreciated that while obturator 500 shown in FIG. 6 is a ball, an obturator 500 of other embodiments may be any other suitable shape or device for sealing against a protective sheath 272 and or a seat gasket and obstructing flow through the sleeve flow bore. The seat assembly 400 can further include an obturator 500 having a diameter larger than the inner diameters 120 and 470 of the seat 300 and the outer tubular member 310, respectively.

Figure 8:
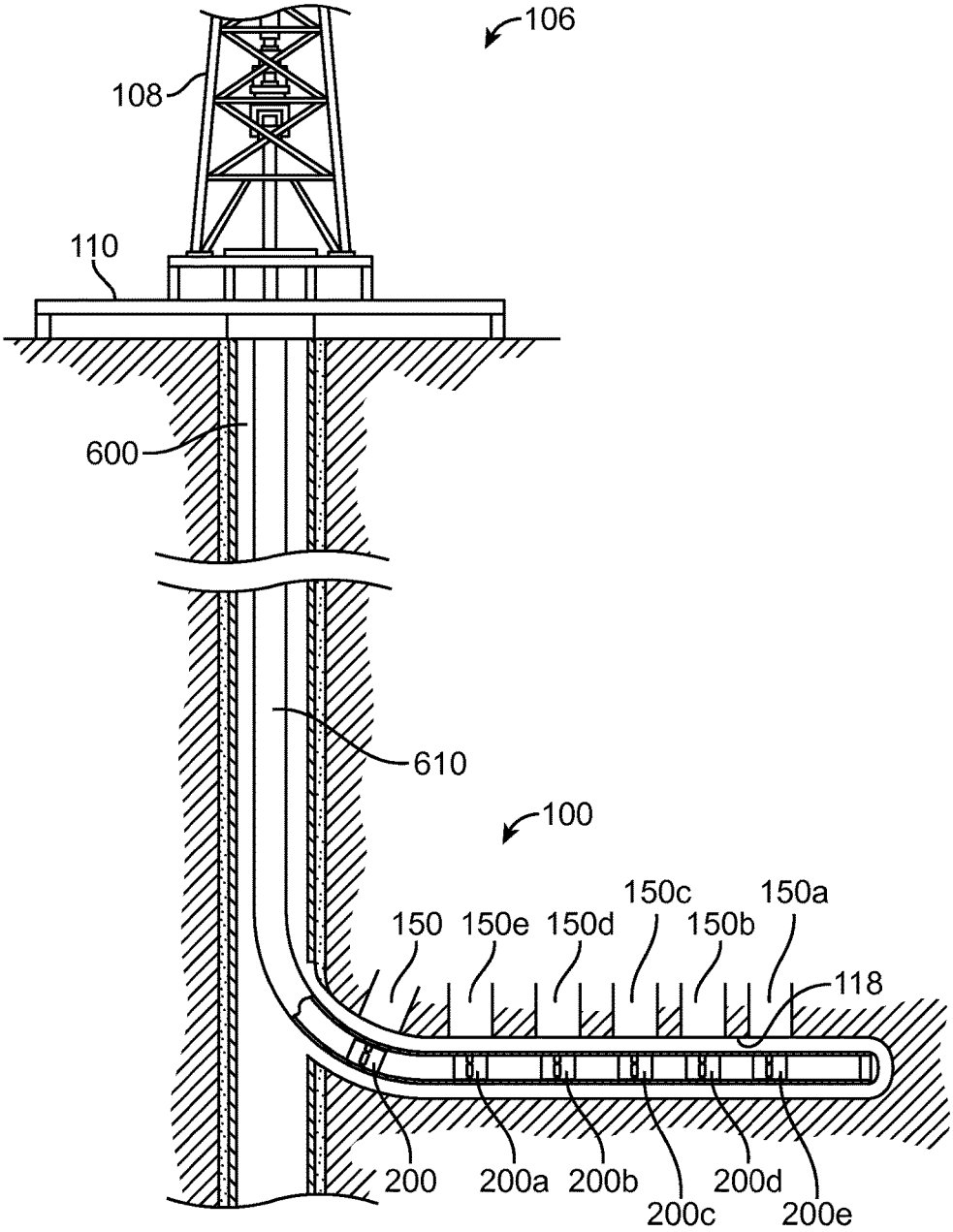
FIG. 8 is a diagram illustrating an embodiment of a drilling rig for drilling a wellbore according to the present disclosure.

Referring to FIG. 8, an example of a wellbore servicing system 100 is shown in an example of an operating environment. As depicted, the operating environment includes a servicing rig 106 (e.g., a drilling, completion, or 'workover' rig) that is positioned on the earth's surface and extends over and around a wellbore 600 that penetrates a subterranean formation for the purpose of recovering hydrocarbons. The wellbore 600 may be drilled into the subterranean formation using any suitable drilling technique. The wellbore 600 extends substantially vertically away from the earth's surface over a vertical wellbore portion, deviates from vertical relative to the earth's surface over a deviated wellbore portion, and transitions to a horizontal wellbore portion 118. In alternative operating environments, all or portions of a wellbore may be vertical, deviated at any suitable angle, horizontal, and/or curved.

At least a portion of the vertical wellbore portion is lined with a casing that is secured into position against the subterranean formation in a conventional manner using cement. In alternative operating environments, a horizontal wellbore portion may be cased and cemented and/or portions of the wellbore may be uncased. The servicing rig 106 has a derrick 108 with a rig floor 110 through which work string 610 is provided having a tubular conveyance (e.g., tubing, jointed pipe, coiled tubing, casing, sleeves etc.) extends downward from the servicing rig 106 into the wellbore 600. The work string 610 can have other conveyances such as cable, wireline, E-line, Z-line. The work string 610 delivers the wellbore servicing system to a selected depth within the wellbore 600 to perform an operation such as perforating the casing and/or subterranean formation, creating perforation tunnels and/or fractures (e.g., dominant fractures, micro-fractures, etc.) within the subterranean formation, producing hydrocarbons from the subterranean formation, and/or other completion operations. The servicing rig 106 includes a motor driven winch and other associated equipment for extending the work string 610 into the wellbore 600 to position the wellbore servicing system at the selected depth.

While the operating environment depicted in FIG. 8 refers to a stationary servicing rig 106 for lowering and setting the wellbore servicing system within a land-based wellbore 600, in alternative embodiments, mobile 'workover' rigs, wellbore servicing units (such as coiled tubing units), and the like may be used to lower a wellbore servicing system into a wellbore. It should be understood that a wellbore servicing system may alternatively be used in other operational environments, such as within an offshore wellbore operational environment.

The subterranean formation includes a zone 150 associated with deviated wellbore portion. The subterranean formation further includes first, second, third, fourth, and fifth horizontal zones, 150*a*, 150*b*, 150*c*, 150*d*, 150*e*, respectively, associated with the horizontal wellbore portion 118. The zones 150, 150*a*, 150*b*, 150*c*, 150*d*, 150*e* are offset from each other along the length of the wellbore 600 in the following order of increasingly downhole location: 150, 150*e*, 150*d*, 150*c*, 150*b*, and 150*a*. A plurality of sleeve systems 200 can be employed, each having a seat assembly 400 having the same or different sized bore 120 diameters. As illustrated, the sleeve systems 200, 200*a*, 200*b*, 200*c*, 200*d*, and 200*e* are located within wellbore 600 in the work string 610 and are associated with zones 150, 150*a*, 150*b*, 150*c*, 150*d*, and 150*e*, respectively. It will be appreciated that zone isolation devices such as annular isolation devices (e.g., annular packers and/or 'swellpackers') may be selectively disposed within wellbore 600 in a manner that restricts fluid communication between spaces immediately uphole and downhole of each annular isolation device.

Numerous examples are provided herein to enhance understanding of the present disclosure. A specific set of examples are provided as follows.

In a first example, an adjustable obturator receiving seat is disclosed, including a bore passing through the seat and having a central axis; and a plurality of cuts extending radially from the bore to an outer perimeter of the seat, the plurality of cuts extending a distance longitudinally along the length of the central axis, wherein each of the plurality of cuts is present at an angle oblique to a peripheral circumference of the bore.

In a second example, there is disclosed an adjustable obturator receiving seat according to the first example, wherein each of the plurality of cuts are curved as they extend from the bore to the outer perimeter of the seat.

In a third example, there is disclosed an adjustable obturator receiving seat according to the first or second examples, wherein each of the plurality of cuts are oblique to the outer perimeter of the seat.

In a fourth example, there is disclosed an adjustable obturator receiving seat according to any of the preceding examples first to the third, wherein the plurality of cuts form a plurality of segments having a broader outer periphery narrowing toward an end terminating at the bore.

In a fifth example, there is disclosed an adjustable obturator receiving seat according to any of the preceding examples first to the fourth, wherein the seat is made from a drillable material selected from the group consisting of composites, phenolics, cast iron, aluminum, brass, various metal alloys, rubbers, ceramics, or combinations thereof.

In a sixth example, there is disclosed an adjustable obturator receiving seat according to any of the preceding examples first to the fifth, wherein the plurality of cuts is each made at the same angle to the peripheral circumference of the bore.

In a seventh example, there is disclosed an adjustable obturator receiving seat according to any of the preceding examples first to the sixth, wherein the seat is conical shaped on at least one side.

In an eighth example, there is disclosed an adjustable obturator receiving seat assembly, including an outer tubular member, a seat disposed within at least a portion of the outer tubular member, the seat having a bore and a plurality of cuts radially extending from the bore to an outer perimeter of the seat, wherein each of the plurality of cuts is present at an angle oblique to a peripheral circumference of the bore.

In a ninth example, there is disclosed an adjustable obturator receiving seat assembly according to the eighth example, wherein each of the plurality of cuts is curved as they extend from the bore to the outer perimeter of the seat.

In a tenth example, there is disclosed an adjustable obturator receiving seat assembly according to the eighth or ninth examples, wherein the outer tubular member has a plurality of cuts which are aligned with the plurality of cuts in the seat.

In an eleventh example, there is disclosed an adjustable obturator receiving seat assembly according to any of the preceding examples eighth to the tenth, wherein the plurality of cuts form a plurality of segments having a broader outer periphery narrowing toward an end terminating at the bore.

In a twelfth example, there is disclosed an adjustable obturator receiving seat assembly according to any of the preceding examples eighth to the eleventh, wherein a second end of the outer tubular member has an internally threaded surface which couples with an externally threaded outer surface of the seat.

In a thirteenth example, there is disclosed an adjustable obturator receiving seat assembly according to any of the preceding examples eighth to the twelfth, wherein the seat is conical shaped on at least one side.

In a fourteenth example, there is disclosed an adjustable obturator receiving seat assembly according to any of the preceding examples eighth to the thirteenth, wherein the plurality of cuts in the seat is each made at the same angle to the peripheral circumference of the bore.

In a fifteenth example, there is disclosed an adjustable obturator receiving seat assembly according to any of the preceding examples eighth to the fourteenth, wherein the plurality of cuts are straight as they extend from the bore to the outer perimeter of the seat.

In a sixteenth example, there is disclosed a system including a work string positioned within a wellbore, the work string including a tubular conveyance and at least one seat assembly contained within at least a portion of the tubular conveyance, the at least one seat assembly including: a seat disposed within at least a portion of an outer tubular member, the seat having a bore and a plurality of cuts radially extending from the bore to an outer perimeter of the seat, wherein each of the plurality of cuts is present at an angle oblique to a peripheral circumference of the bore.

In a seventeenth example, there is disclosed a system according to the sixteenth example, wherein the at least one seat assembly further includes an outer tubular member, wherein the seat is disposed within at least a portion of the outer tubular member.

In an eighteenth example, there is disclosed a system according to the sixteenth or seventeenth examples, wherein the plurality of cuts are curved as they extend from the bore to the outer perimeter of the seat.

In a nineteenth example, there is disclosed an adjustable obturator receiving seat assembly according to any of the preceding examples sixteenth to the eighteenth, wherein the plurality of cuts form a plurality of segments having a broader outer periphery narrowing toward an end terminating at the bore.

In a twentieth example, there is disclosed an adjustable obturator receiving seat assembly according to any of the preceding examples sixteenth to the nineteenth, further including an obturator sized to pass through the work string.

In a twenty first example, there is disclosed a method of servicing a wellbore including, positioning a work string within a wellbore, the work string including a tubular conveyance and at least one seat assembly contained within at least a portion of the tubular conveyance, the at least one seat assembly including: a seat disposed within at least a portion of an outer tubular member, the seat having a bore and a plurality of cuts radially extending from the bore to an outer perimeter of the seat, wherein each of the plurality of cuts is present at an angle oblique to a peripheral circumference of the bore.

In a twenty second example, there is disclosed a method according to the twenty first example, the at least one seat assembly further including an outer tubular member, wherein the seat is disposed within at least a portion of the outer tubular member.

In a twenty third example, there is disclosed a method according to the twenty first or twenty second examples, wherein the plurality of cuts are curved as they extend from the bore to the outer perimeter of the seat.

In a twenty fourth example, there is disclosed an adjustable obturator receiving seat assembly according to any of the preceding examples twenty first to the twenty third, wherein the plurality of cuts form a plurality of segments having a broader outer periphery narrowing toward an end terminating at the bore In a twenty fifth example, there is disclosed an adjustable obturator receiving seat assembly according to any of the preceding examples twenty first to the twenty fourth, further including passing an obturator through a portion of the work string.

The embodiments shown and described above are only examples. Many details are often found in the art such as the other features of a rotary steerable drilling systems, and particularly anti-rotation devices used in such systems. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. An adjustable obturator receiving seat comprising:

a bore passing through the seat and having a central axis; and a plurality of cuts extending radially from the bore through an outer perimeter of the seat, the plurality of cuts extending a distance longitudinally along the length of the central axis, wherein each of the plurality of cuts is present point tangential to a peripheral circumference of the bore in a direction extending from the bore to the outer perimeter of the seat.

2. The seat of claim 1, wherein each of the plurality of cuts are curved as they extend from the bore to the outer perimeter of the seat.

3. The seat of claim 1, wherein each of the plurality of cuts are oblique to the outer perimeter of the seat.

4. The seat of claim 1, wherein the plurality of cuts form a plurality of segments having a broader outer periphery narrowing toward an end terminating at the bore.

5. The seat of claim 1, wherein the seat is made from a drillable material selected from the group consisting of composites, phenolics, cast iron, aluminum, brass, various metal alloys, rubbers, ceramics, or combinations thereof.

6. The seat of claim 1, wherein the plurality of cuts is each made at the same angle to the peripheral circumference of the bore.

7. The seat of claim 1, wherein the seat is conical shaped on at least one side.

8. An adjustable obturator receiving seat assembly comprising:

an outer tubular member, a seat disposed within at least a portion of the outer tubular member, the seat having a bore and a plurality of cuts radially extending from the bore through an outer perimeter of the seat, wherein each of the plurality of cuts is present point tangential to a peripheral circumference of the bore in a direction extending from the bore to the outer perimeter of the seat.

9. The seat assembly of claim 8, wherein each of the plurality of cuts is curved as they extend from the bore to the outer perimeter of the seat.

10. The seat assembly of claim 8, wherein the outer tubular member has a plurality of cuts which are aligned with the plurality of cuts in the seat.

11. The seat assembly of claim 8, wherein the plurality of cuts form a plurality of segments having a broader outer periphery narrowing toward an end terminating at the bore.

12. The seat assembly of claim 8, wherein one end of the outer tubular member has an internally threaded surface which couples with an externally threaded outer surface of the seat.

13. The seat assembly of claim 8, wherein the seat is conical shaped on at least one side.

14. The seat assembly of claim 8, wherein the plurality of cuts in the seat is each made at the same angle to the peripheral circumference of the bore.

15. The seat assembly of claim 8, wherein the plurality of cuts are straight as they extend from the bore to the outer perimeter of the seat.

16. A system comprising:

a work string positioned within a wellbore, the work string comprising a tubular conveyance and at least one seat assembly contained within at least a portion of the tubular conveyance, the at least one seat assembly comprising:

a seat disposed within at least a portion of an outer tubular member, the seat having a bore and a plurality of cuts radially extending from the bore through an outer perimeter of the seat, wherein each of the plurality of cuts is present point tangential to a peripheral circumference of the bore in a direction extending from the bore to the outer perimeter of the seat.

17. The system of claim 16, the at least one seat assembly further comprising an outer tubular member, wherein the seat is disposed within at least a portion of the outer tubular member.

18. The system of claim 16, wherein the plurality of cuts are curved as they extend from the bore to the outer perimeter of the seat.

19. The system of claim 16, wherein the plurality of cuts form a plurality of segments having a broader outer periphery narrowing toward an end terminating at the bore.

20. The system of claim 16, further comprising an obturator sized to pass through the work string.

21. A method of servicing a wellbore comprising:

positioning a work string within a wellbore, the work string comprising a tubular conveyance and at least one seat assembly contained within at least a portion of the tubular conveyance, the at least one seat assembly comprising:

a seat disposed within at least a portion of an outer tubular member, the seat having a bore and a plurality of cuts radially extending from the bore through an outer perimeter of the seat, wherein each of the plurality of cuts is present point tangential to a peripheral circumference of the bore in a direction extending from the bore to the outer perimeter of the seat.

22. The method of claim 21, the at least one seat assembly further comprising an outer tubular member, wherein the seat is disposed within at least a portion of the outer tubular member.

23. The method of claim 21, wherein the plurality of cuts are curved as they extend from the bore to the outer perimeter of the seat.

24. The method of claim 21, wherein the plurality of cuts form a plurality of segments having a broader outer periphery narrowing toward an end terminating at the bore.

25. The method of claim 21, further comprising passing an obturator through a portion of the work string.

* * * * *